US010518282B2

(12) United States Patent
Ksiazek et al.

(10) Patent No.: US 10,518,282 B2
(45) Date of Patent: Dec. 31, 2019

(54) DRINK AND MISTING BOTTLE WITH TRIGGER LOCK

(71) Applicant: O2Cool, LLC, Chicago, IL (US)

(72) Inventors: Michael Ksiazek, Burr Ridge, IL (US); Eric F. Junkel, Mount Prospect, IL (US); Tom Zeng, Shenzhen (CN)

(73) Assignee: O2COOL, LLC, Chicago, IL (US)

( * ) Notice: Subject to any disclaimer, the term of this patent is extended or adjusted under 35 U.S.C. 154(b) by 0 days.

(21) Appl. No.: 15/483,033

(22) Filed: Apr. 10, 2017

(65) Prior Publication Data

US 2018/0290164 A1 Oct. 11, 2018

(51) Int. Cl.
*B05B 11/00* (2006.01)

(52) U.S. Cl.
CPC ..... *B05B 11/3059* (2013.01); *B05B 11/0086* (2013.01); *B05B 11/3047* (2013.01); *B05B 11/3057* (2013.01)

(58) Field of Classification Search
CPC ..... B05B 11/0086; B05B 11/3059; B05B 11/3047; B05B 11/3057
See application file for complete search history.

(56) References Cited

U.S. PATENT DOCUMENTS 3,913,844 A 10/1975 Petrovic
4,373,644 A * 2/1983 Bennett ..... B05B 11/3059 222/153.13
4,441,633 A 4/1984 Bennett
4,506,805 A 3/1985 Marcon
4,805,812 A 2/1989 Brody
4,867,347 A 9/1989 Wass et al.
4,932,563 A * 6/1990 Diamond ..... A45F 3/16 222/129
5,169,032 A 12/1992 Steijns et al.
5,228,600 A 7/1993 Steijns et al.
5,238,152 A 8/1993 Maas et al.
5,297,701 A 3/1994 Steijns et al.
5,823,395 A 10/1998 Foster et al.
6,003,738 A 12/1999 Foster et al.
6,010,034 A * 1/2000 Walthers ..... A47G 19/2266 222/129
6,217,294 B1 * 4/2001 Arnieri ..... A45F 3/16 222/135
6,244,469 B1 6/2001 Knickerbocker
(Continued)

FOREIGN PATENT DOCUMENTS

WO WO2013/171906 * 11/2013 ..... B05B 11/3057

*Primary Examiner* — J C Jacyna
(74) *Attorney, Agent, or Firm* — Thompson Coburn LLP

(57) ABSTRACT

A bottle closure includes a drink spout, pump mechanism, trigger mechanism and lock mechanism. The trigger mechanism is moveable between a first trigger position and a second trigger position. The lock mechanism is engageable with the trigger mechanism and movable between an engaged position and a disengaged position. The lock mechanism is adapted to engage the trigger mechanism when the lock mechanism is in the engaged position and thereby prevent the trigger mechanism from moving from the first trigger position to the second trigger position. The lock mechanism is further adapted to permit the trigger mechanism to move from the first trigger position to the second trigger position when the lock mechanism is in the disengaged position.

12 Claims, 15 Drawing Sheets

(56) References Cited

U.S. PATENT DOCUMENTS

| | | | | |
|---|---|---|---|---|
| 6,983,864 | B1 | 1/2006 | Cagle | |
| 7,143,958 | B1 * | 12/2006 | Dorney | B05B 3/022 239/289 |
| 7,210,602 | B2 * | 5/2007 | Blanchester | B05B 11/0086 215/389 |
| 7,735,689 | B2 | 6/2010 | Alluigi | |
| 8,230,888 | B2 | 7/2012 | Crossdale et al. | |
| 8,544,691 | B2 | 10/2013 | Roosel et al. | |
| 8,657,160 | B2 | 2/2014 | Lashells et al. | |
| 8,684,235 | B2 * | 4/2014 | Inaba | B05B 11/0029 222/153.13 |
| 2005/0035154 | A1 * | 2/2005 | Meshberg | B05B 11/3059 222/153.13 |
| 2006/0113327 | A1 * | 6/2006 | Walters | B05B 11/3014 222/153.11 |
| 2006/0113329 | A1 * | 6/2006 | Walters | B05B 11/3014 222/383.1 |
| 2007/0228190 | A1 | 10/2007 | Tanner | |
| 2009/0032618 | A1 * | 2/2009 | Hornsby | B05B 15/33 239/333 |
| 2009/0184177 | A1 * | 7/2009 | Wu | A46B 11/00 239/274 |
| 2009/0314811 | A1 * | 12/2009 | Dennis | B05B 11/3045 222/464.1 |
| 2013/0001323 | A1 * | 1/2013 | Bodet | B05B 11/3057 239/337 |
| 2014/0346257 | A1 | 11/2014 | Reetz, III et al. | |
| 2016/0214125 | A1 * | 7/2016 | Hextall | B05B 11/0086 |
| 2016/0228899 | A1 * | 8/2016 | Gonzalez | B05B 11/3084 |
| 2017/0157632 | A1 * | 6/2017 | Alluigi | B05B 11/007 |
| 2019/0083996 | A1 * | 3/2019 | Sakata | B05B 11/3009 |

* cited by examiner

DRINK AND MISTING BOTTLE WITH TRIGGER LOCK

CROSS-REFERENCE TO RELATED APPLICATIONS

Not applicable.

STATEMENT REGARDING FEDERALLY SPONSORED RESEARCH OR DEVELOPMENT

Not Applicable.

APPENDIX

Not Applicable.

BACKGROUND

Field of the Disclosure

The present disclosure pertains to a bottle closure having a drink spout, trigger actuated pump and misting nozzle, and a lock mechanism for preventing and permitting actuation of the pump and misting nozzle.

SUMMARY

One aspect of the present disclosure is a bottle closure for releasable attachment to a bottle and for providing hydration to a user. The bottle closure includes a drink spout adapted and configured to be in fluid communication with a bottle to enable a user to extract a liquid. The bottle closure further includes a pump mechanism adapted and configured to be in fluid communication with a bottle to enable a liquid to be pumped and discharged through a nozzle. A trigger mechanism is operatively connected to the pump mechanism and moveable between a first trigger position and a second trigger position, and the trigger mechanism is adapted and configured to actuate the pump mechanism to pump a liquid as the trigger mechanism is moved between the first trigger position and the second trigger position. The bottle closure further includes a lock mechanism engageable with the trigger mechanism and movable between an engaged position and a disengaged position. The lock mechanism is adapted and configured to engage the trigger mechanism when the lock mechanism is in the engaged position and thereby prevent the trigger mechanism from moving from the first trigger position to the second trigger position. The lock mechanism is further adapted to permit the trigger mechanism to move from the first trigger position to the second trigger position when the lock mechanism is in the disengaged position.

Another aspect of the disclosure is a bottle closure for releasable attachment to a bottle and for providing hydration to a user, the bottle closure including a first discharge aperture for dispensing a liquid and a body. The bottle closure further includes a pump mechanism supported by the body and including a variable volume fluid receiving cavity and a plunger reciprocally moveable within the fluid receiving cavity between a first plunger position in which the fluid receiving cavity has a first volume and a second plunger position in which the fluid receiving cavity has a second volume smaller than the first volume. The plunger is configured to change the volume of the fluid receiving cavity as the pump mechanism moves between the first plunger position and the second plunger position. The pump mechanism includes a first check valve in a first intake liquid flow path configured for permitting fluid flow to the fluid receiving cavity from the first intake liquid flow path and for checking fluid flow from the pump mechanism to the first intake liquid flow path, the pump mechanism including a second check valve in a first discharge liquid flow path configured for permitting fluid flow from the fluid receiving cavity to the first discharge liquid flow path and for checking fluid flow from the first discharge liquid flow path to the fluid receiving cavity. The first discharge liquid flow path terminates at the first discharge aperture. The bottle closure also includes a trigger operatively connected to the plunger and reciprocally moveable relative to the body between a first trigger position and a second trigger position to move the plunger between the first and second plunger position. The plunger and trigger are configured such that the plunger is in the first plunger position when the trigger is in the first trigger position and the plunger is in the second plunger position when the trigger is in the second trigger position. The bottle closure further includes a lock mechanism engageable with the trigger and movable between an engaged position and a disengaged position. The lock mechanism is configured to engage the trigger when the lock mechanism is in the engaged position and thereby prevent the trigger from moving from the first trigger position to the second trigger position. The lock mechanism is further configured to permit the trigger to move from the first trigger position to the second trigger position when the lock mechanism is in the disengaged position. A second discharge aperture of the bottle closure is separated from the first discharge aperture, the second discharge aperture in fluid communication with a second intake liquid flow path.

A still further aspect of the disclosure is a container for providing hydration including a bottle having a bottle finish and a bottle closure adapted and configured to be releasably secured to the bottle by the bottle finish. The bottle closure includes a body and a drink spout adapted and configured to be in fluid communication with the bottle to enable a user to extract a liquid. The bottle closure further includes a pump mechanism coupled to the body and adapted and configured to be in fluid communication with the bottle to enable a liquid to be pumped and discharged through a nozzle. A trigger mechanism is coupled to the body and operatively connected to the pump mechanism and moveable between a first trigger position and a second trigger position. The trigger mechanism is adapted and configured to actuate the pump mechanism to pump a liquid as the trigger mechanism is moved between the first trigger position and the second trigger position. The bottle closure also includes a lock mechanism engageable with the trigger mechanism. The lock mechanism is movable between an engaged position and a disengaged position. The lock mechanism is adapted and configured to engage the trigger mechanism when the lock mechanism is in the engaged position and thereby prevent the trigger mechanism from moving from the first trigger position to the second trigger position. The lock mechanism is further configured to permit the trigger mechanism to move from the first trigger position to the second trigger position when the lock mechanism is in the disengaged position.

Further features and advantages, as well as the structure and operation of various embodiments disclosed herein, are described in detail below with reference to the accompanying drawings.

BRIEF DESCRIPTION OF THE DRAWINGS

The accompanying drawings, which are incorporated in and form a part of the specification, illustrate the embodiments of the present disclosure and together with the description, serve to explain the principles of the disclosed embodiments. In the drawings.

Figure 1:
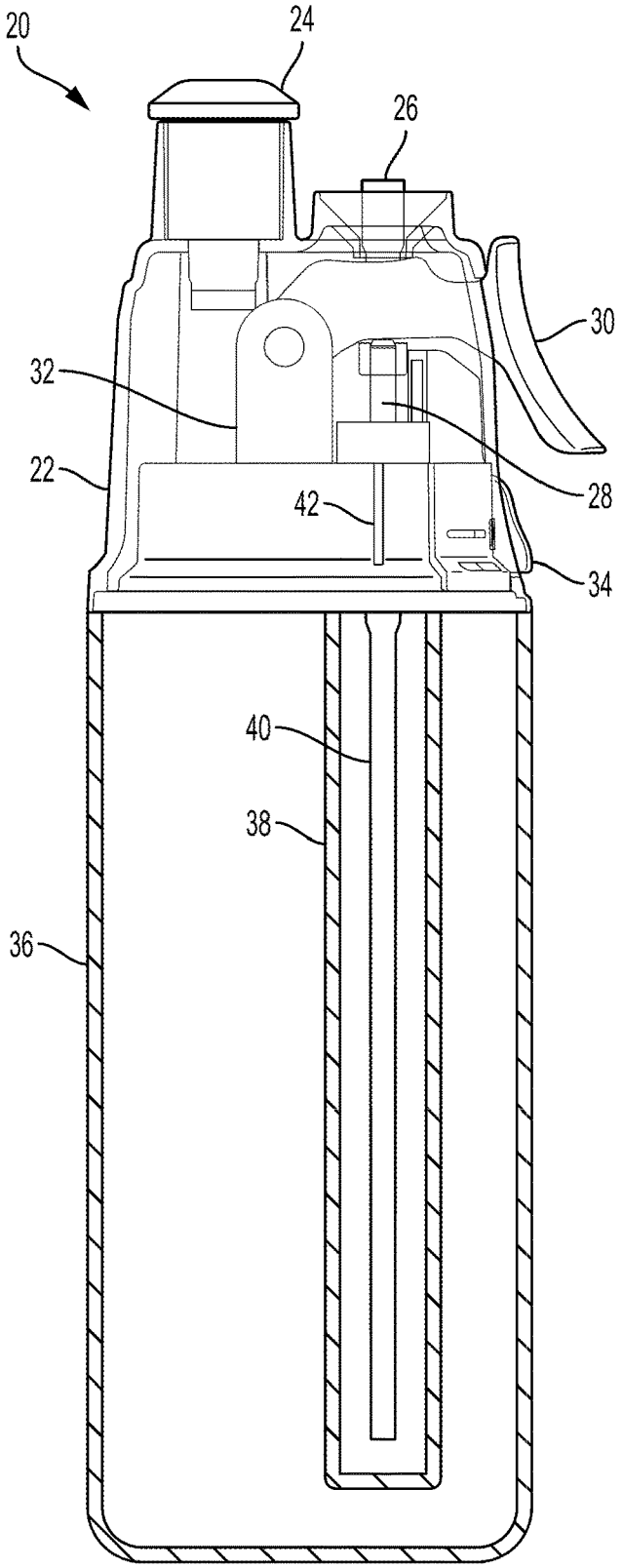
FIG. 1 is an elevation partial cross-section view of an embodiment of a bottle closure with a lock for a trigger actuated pump and a bottle.

Reference numerals in the written specification and in the drawings figures indicate corresponding items.

DETAILED DESCRIPTION OF THE PREFERRED EMBODIMENT

In one embodiment, as shown in FIG. 1, a container 20 for providing hydration includes a bottle closure 22 and bottle 36. The bottle closure 22 includes a drink spout 24 and a nozzle 26 adapted and configured to dispense a liquid. The nozzle 26 defines a first aperture through which liquid is dispensed, preferably in a mist. The nozzle 26 is adapted and configured to generate a mist, but, in alternative embodiments, may be adapted and configured to dispense liquid in alternative patterns. For example, and without limitation, the nozzle 26 may be adapted and configured to produce a stream. The drink spout 24 defines a second aperture through which liquid is dispensed. A user can open drink spout 24 to allow the user to extract the liquid through the second aperture. The user can also close drink spout 24 to seal the second aperture.

The pump mechanism 28 is adapted and configured to enable a liquid to be pumped and discharged through nozzle 26. The pump mechanism 28 is driven by a trigger mechanism 30. The trigger mechanism 30 is coupled to the body 32 of the bottle closure 22 and is operatively connected to the pump mechanism 28. The trigger mechanism 30 is moveable between a first trigger position and a second trigger position. The trigger mechanism 30 is adapted and configured to actuate the pump mechanism 28 to pump a liquid as the trigger mechanism 30 is moved between the first trigger position and the second trigger position.

The bottle closure 22 includes a lock mechanism 34 that is engageable with the trigger mechanism 30. The lock mechanism 34 is movable between an engaged position and a disengaged position. The lock mechanism 34 is adapted and configured to engage the trigger mechanism 30 when the lock mechanism 34 is in the engaged position and thereby prevent the trigger mechanism 30 from moving from the first trigger position to the second trigger position. In the engaged position, the lock mechanism 34 is interposed between the trigger mechanism 30 and the body 32 to prevent movement of the trigger mechanism 30 and pump mechanism 28 by extension. Advantageously, the lock mechanism 34 prevents accidental actuation on the pump mechanism 28 such as, for example, when the container 20 is stored in a purse or gym bag. The lock mechanism 34 is further configured to permit the trigger mechanism 30 to move from the first trigger position to the second trigger position when the lock mechanism 34 is in the disengaged position. By selectively permitting and preventing the trigger mechanism 30 from moving between the first trigger position and the second trigger position, lock mechanism 34 permits or prevents actuation of pumping mechanism 28. Lock mechanism 30 thereby permits discharging a liquid, e.g., as a mist, from nozzle 26, when the lock mechanism is in the disengaged position, and prevents discharging a liquid when the lock mechanism is in the engaged position.

The bottle closure 22 is releasably securable to a bottle 36. The drink spout 24 is in fluid communication with the bottle 36 such that a user can extract a liquid within the bottle 36 through the aperture defined by the drink spout 24. In the embodiment depicted, the bottle closure 22 is releasably securable to a secondary bottle 38. A dip tube 40 extends within the secondary bottle 38 and is coupled to pumping mechanism 28. Pumping mechanism 28 draws a liquid from the secondary bottle 38 through the dip tube 40 and expels the fluid through the nozzle 26 when the pumping mechanism 28 is driven by the trigger mechanism 30. The secondary bottle 38 may be releasably coupled to the bottle closure 22 such that the secondary bottle 38 is suspended within the bottle 36. In alternative embodiments, the secondary bottle 38 is secured to, shares a wall with, and/or is formed as part of the bottle 36. The secondary bottle 38 allows the bottle closure 22 to dispense two different liquids. A first liquid is contained within the bottle 36, and a second liquid is contained within the secondary bottle 38. For example, and without limitation, the secondary bottle 38 may contain a liquid such as water a user may use to mist himself or herself through actuation of the pump mechanism 28 using the trigger mechanism 30. The bottle 36 may contain a different liquid such as a sports drink that a user may extract using the drink spout 24 for consumption.

In still further alternative embodiments, dip tube 40 extends into and is in fluid communication with the bottle 36; in other words, in such embodiment the secondary bottle 38 is omitted. The same liquid is dispensed from both the drink spout 24 and the nozzle 26. The bottle closure 22 may be capable of being coupled to the secondary bottle 38 but is optionally not coupled to the secondary bottle 38. Alternatively, the bottle closure 22 is only able to be coupled to the bottle 36 and may not be coupled to a secondary bottle.

Figure 3:
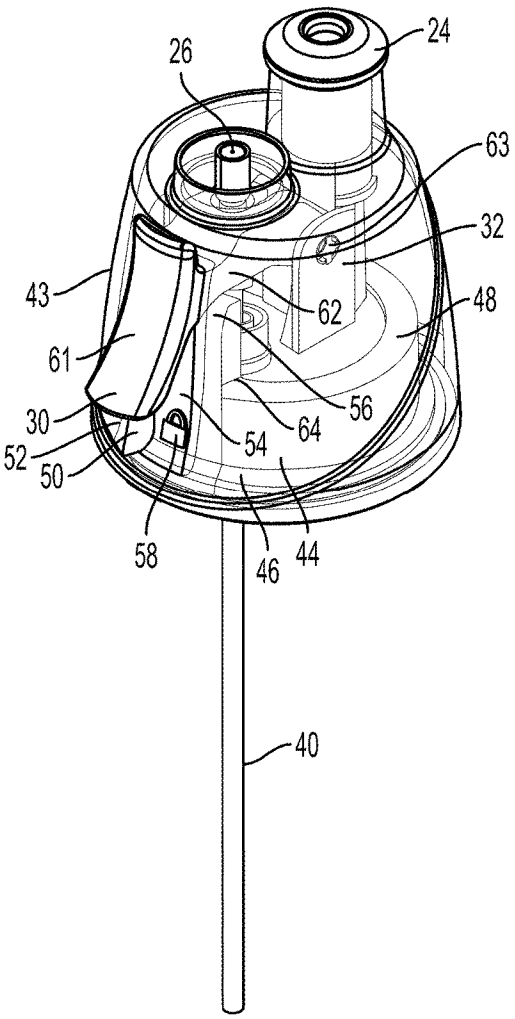
FIG. 3 is a perspective view of the bottle closure shown in FIG. 1 with the trigger lock mechanism in a locked position.
Figure 2:
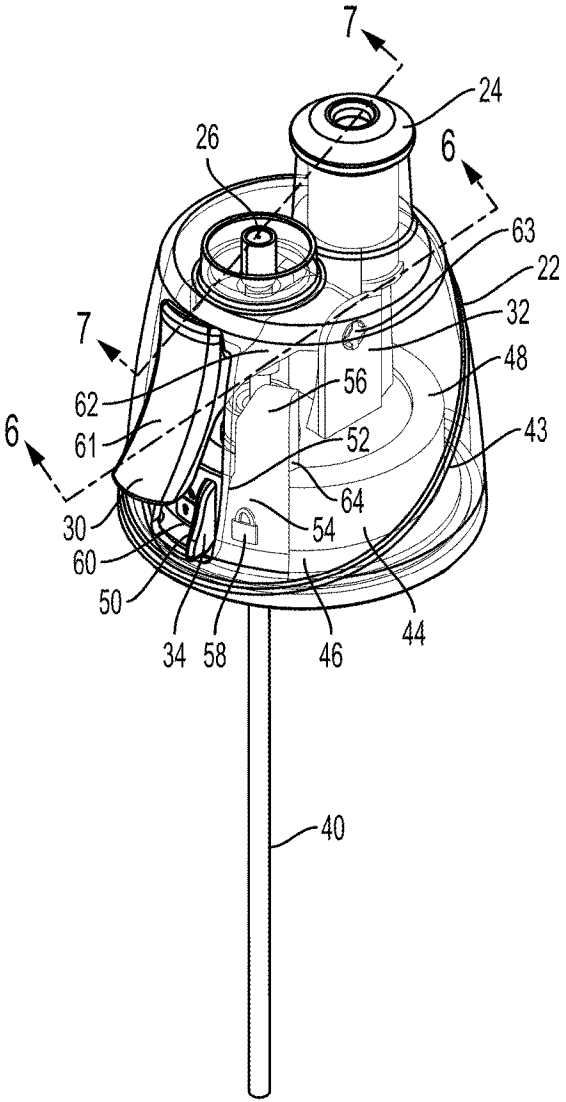
FIG. 2 is a perspective view the bottle closure shown in FIG. 1 with a trigger lock mechanism in an unlocked position.
Figure 4:
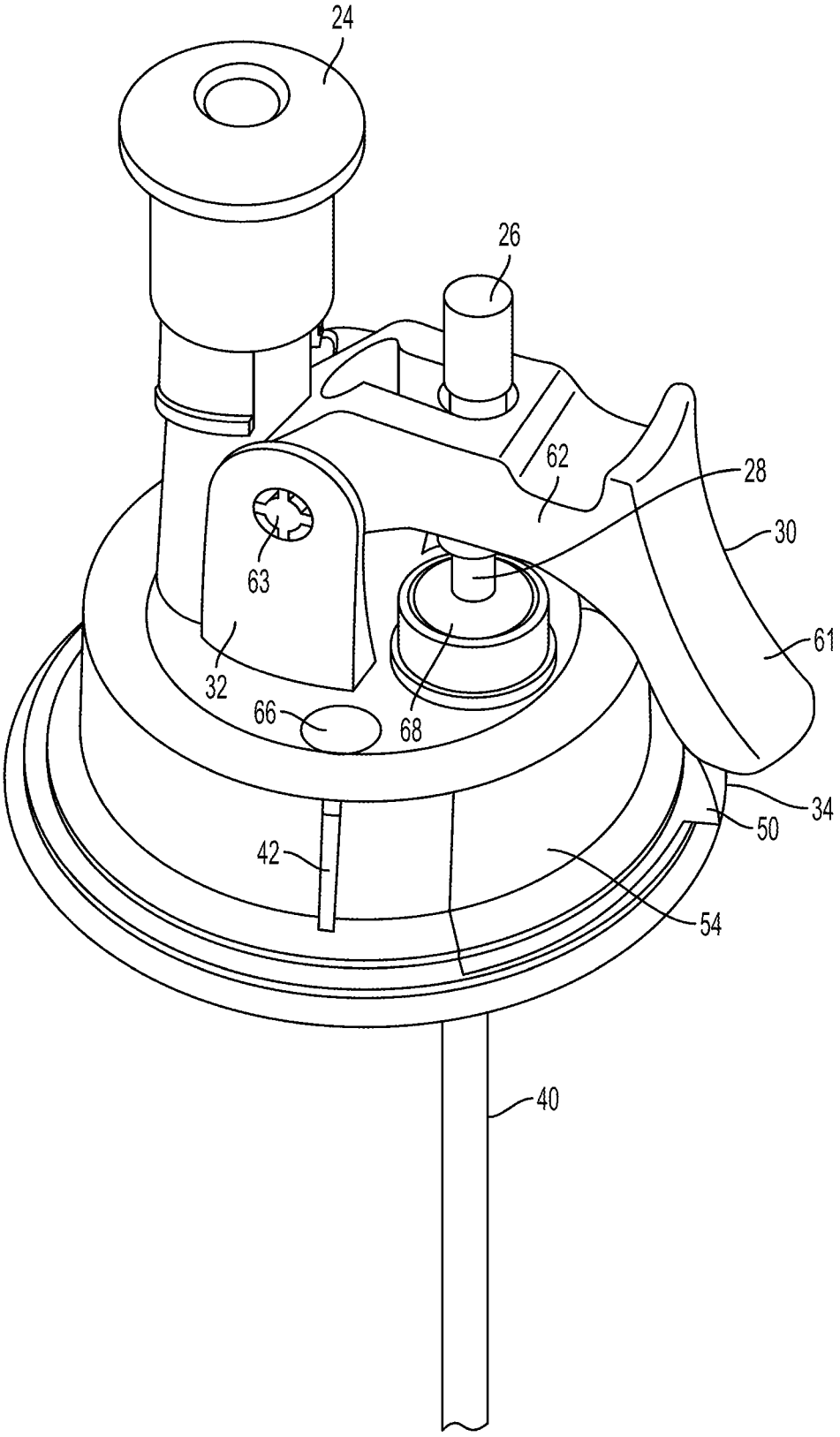
FIG. 4 is a perspective view of the bottle closure shown in FIG. 1 with a cover removed.

Referring to FIGS. 1-3, lock mechanism 30 is movable between a disengaged position, as shown in FIG. 2, and an engaged position, as shown in FIG. 3. The lock mechanism 30 rotates about an axis extending vertically through the bottle closure 22. At least one stop 42 extends radially from the body 32 of the bottle closure 22. The stop 42 is adapted and configured to be engageable with the lock mechanism 34 to limit rotation of the lock mechanism 34 to between the engaged position and the disengaged position.

The bottle closure 22 includes a cover 43. The cover 43 of the bottle closure 22 extends at least in part around the body 32, the pump mechanism 28, and the lock mechanism 34. The cover 43 is coupled to the body 32. As depicted, the cover 43 is translucent, but in other embodiments, the cover 43 may be transparent or opaque. The cover 43 together with a side wall 44, an angled portion 46, and a top portion 48 of the body 32 form a space in which at least a portion of the lock mechanism 34 is positioned. The space formed by the cover 43 the side wall 44, the angled portion 46, and the top portion 48 of the body 32 guide the lock mechanism 34 between the engaged and disengaged positions.

The lock mechanism 34 includes a lever portion 50 that extends from a window 52 in the cover 43. The lever portion 50 allows a user to impart force on the lock mechanism 34 such that the lock mechanism 34 is rotatable between the engaged position and the disengaged position within the channel formed by the cover 43 and the body 32. The lock mechanism includes substantially vertical portion 52 terminating in a flange at a first end and an engaging surface 56 opposite the first end. The vertical portion 54, including the flange at the first end, are adapted and configured to be engageable with the side wall 44 and the angled portion 46 of the body 32 to position the lock mechanism 34 and guide the lock mechanism 34 between the engaged and disengaged positions. The vertical portion 54 of the lock mechanism 34 further includes a base portion 64 extending axially toward the top portion 48 of the body 32. The base portion 64 of the lock mechanism 34 is able to slide along the top portion 48 of the body 32 as the lock mechanism is rotated between engaged and disengaged positions. In this manner, the base portion 64 of the lock mechanism 34 and the top portion 48 of the body limit axial movement of the lock mechanism 34 in one axial direction. The lock mechanism 34 further includes an engaging surface 56 that is adapted and configured to engage with the trigger mechanism 30 when the lock mechanism in the engaged position. The engaging surface 56 is further adapted and configured to be engageable with the cover 43 such that axial movement of the lock mechanism 34 is limited in a second axial direction. The cover 34 includes at least one portion that slopes inward as the cover 43 extends towards the drink spout 24 and the nozzle 26. The engaging surface 56 of the lock mechanism 34 is engageable with the sloping portion of the cover 43 to prevent axial movement of the lock mechanism in the second axial direction.

In alternative embodiments, other structures of one or more of the lock mechanism 34 and the body 32 are used to limit the motion of the lock mechanism 34. For example, and without limitation, lock mechanism 34 may include a ridge extending radially inward and running along the lock mechanism 34, the ridge adapted and configured to engage with a corresponding slot extending radially inward and running along the side wall 44 of the body 32. The ridge and slot can cooperate to limit axial movement of the lock mechanism 34. As an additional example, the base portion 64 of the lock mechanism 34 may include a flange or lip that extends axially and around the top portion 48 of the side wall 44 such that the lip or flange extends along an interior surface of the side wall 44. In this manner, the lock mechanism 34 extends on both sides of the side wall 44 and cooperates with the side wall 44 to limit radial movement of the lock mechanism 34. One or more of these features may also be adapted and configured to limit the rotation of the lock mechanism 34 in place of the stop 42. In still further alternative embodiments, the window 52 in cover 43 is adapted and configured to cooperate with the lever portion 50 of the lock mechanism 34 to limit one or more of the rotation, radial movement, and axial movement of the lock mechanism.

The lock mechanism 34 further includes position indicators 58 and 60. A locked position indicator 58 is visible through window 52 of the cover 43 when the lock mechanism 34 is in the engaged position, as shown in FIG. 3. An unlocked position indicator 60 is visible through window 52 of the cover 43 when the lock mechanism 34 is in the disengaged position, as shown in FIG. 2.

Figure 5:
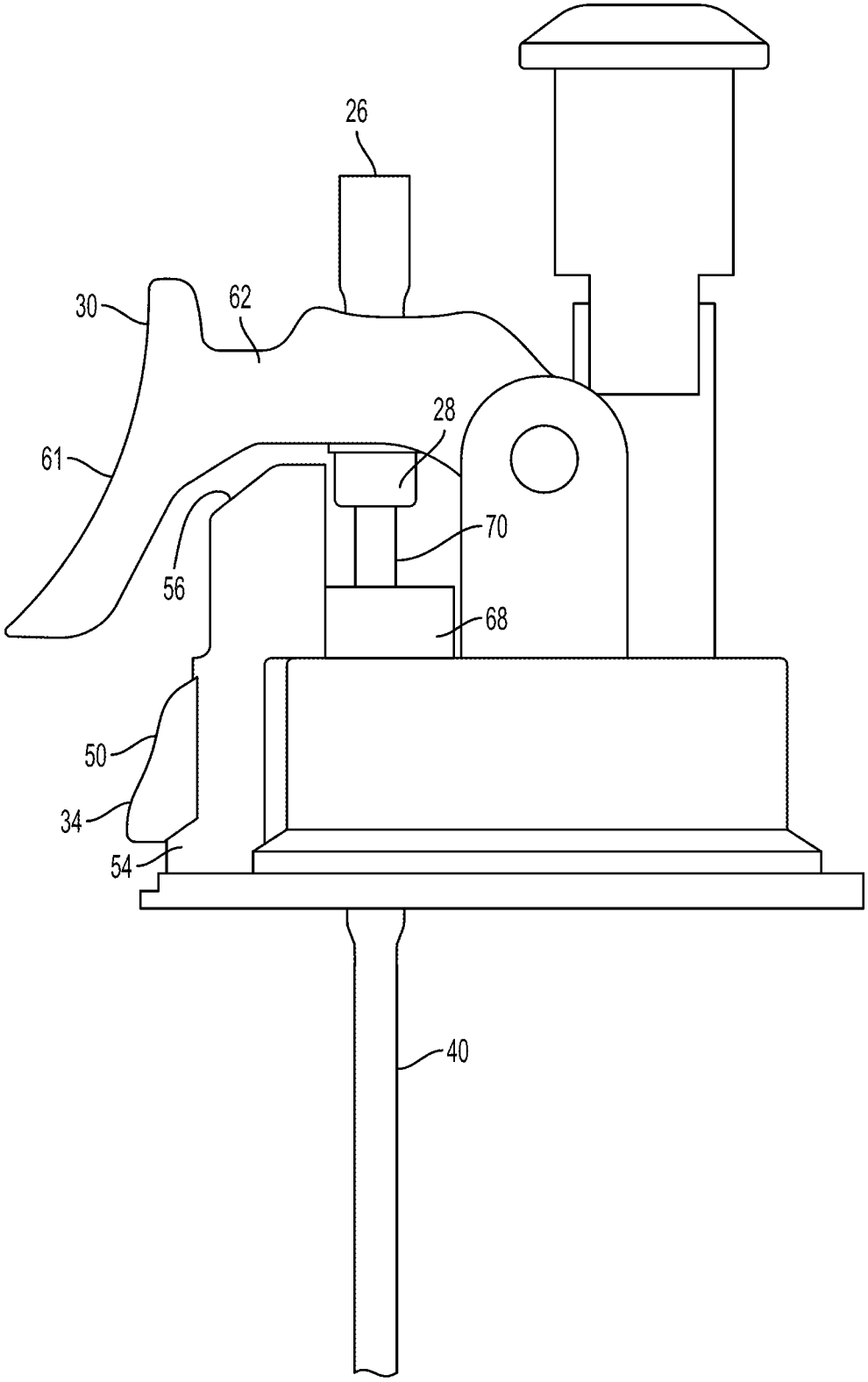
FIG. 5 is an elevation view of the partial bottle closure shown in FIG. 4 with a trigger lock mechanism in an unlocked position, a trigger in a first trigger position, and a plunger in a first plunger position.
Figure 5A:
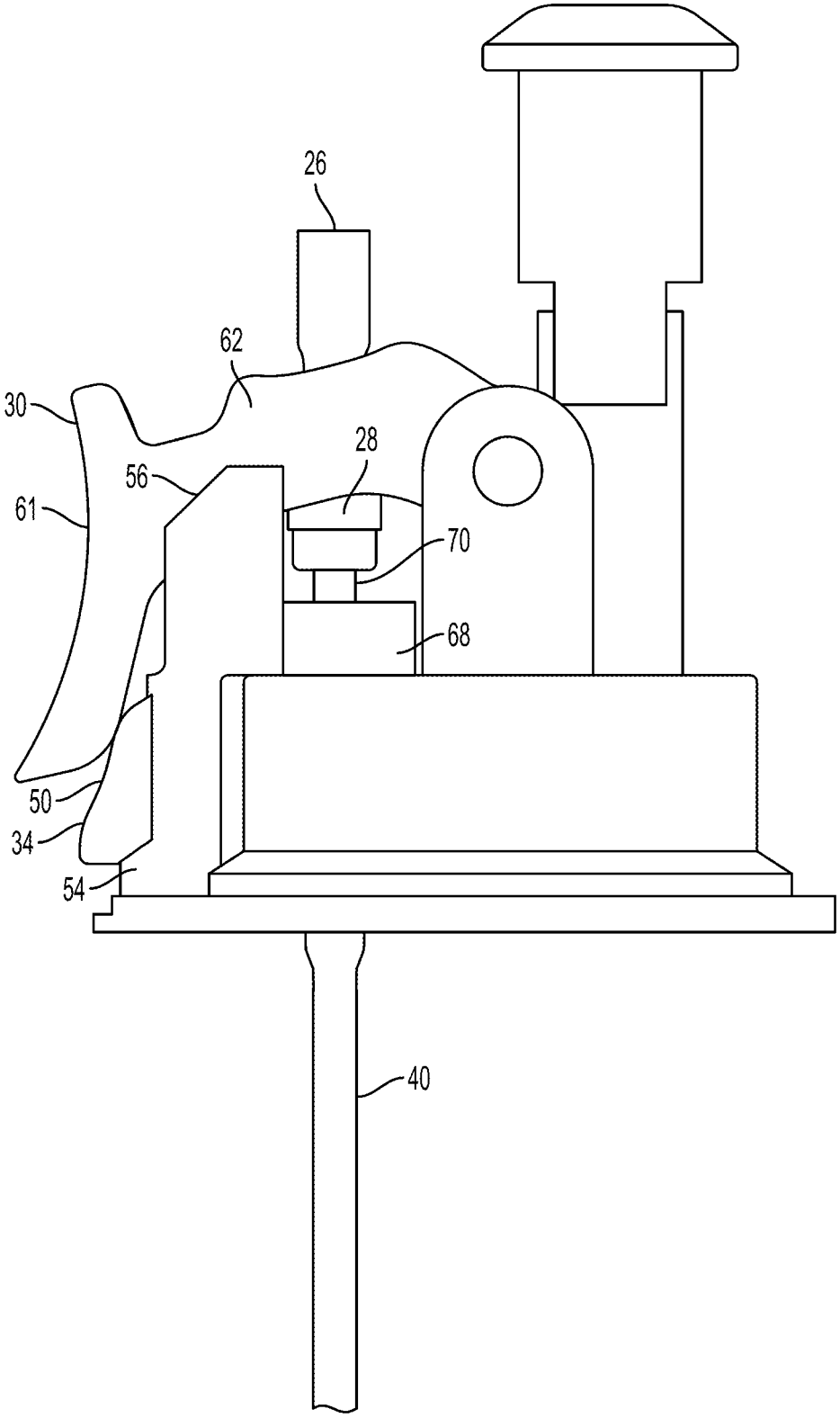
FIG. 5A is an elevation view of the partial bottle closure shown in FIG. 5 with the trigger in a second trigger position and a plunger in a second plunger position.

Referring now to FIGS. 2-5A, the trigger mechanism 30 includes a trigger portion 61, a connecting portion 62, and a pivot portion 63. The pivot portion 63 is pivotally coupled to the body 32 of the bottle closure 22. The connecting portion 62 of the trigger mechanism 34 is adapted and configured to impart a generally vertical force to the pump mechanism 28—when the bottle closure 22 is an upright position—when the trigger portion 61 is actuated by a user and the connecting portion 62 pivots about the body 32 of the closure. Specifically, the connecting portion 62 of the trigger mechanism 34 is operatively connected to a plunger 70 of the pump mechanism 28 at least partially positioned within a cylinder 68 of the pump mechanism 28. The trigger mechanism is reciprocally moveable relative to the body 32 between a first trigger position (as shown in FIG. 5) and a second trigger position (as shown in FIG. 5A) to move the plunger 70 between a first plunger position (as shown in FIG. 5) and a second plunger position (as shown in FIG. 5A). In the first trigger position, the connecting portion 62 is substantially perpendicular to the plunger 70. In the second trigger position, the trigger mechanism 34 has been pivoted and the connecting portion 62 moved along an arc such that the connecting portion 62 is at an acute angle with the plunger 70 and the plunger 70 has been moved relative to the cylinder 68 such that the volume of a fluid receiving cavity defined by the pump mechanism 28 is reduced. The trigger mechanism 30 is adapted and configured such that the plunger 70 is in the first plunger position when the trigger mechanism is in the first trigger position and the plunger 70 is in the second plunger position when the trigger mechanism 30 is in the second trigger position.

The lock mechanism 34 is engageable with the connecting portion 62 of the trigger mechanism 30. When in the engaged position, the lock mechanism 34 is configured to engage the trigger mechanism 30 and thereby prevent the trigger from moving from the first trigger position to the second trigger position. The engaging surface 56 of the lock mechanism 34 limits the travel of the connecting portion 62 of the trigger mechanism 30 preventing the trigger mechanism 30 from moving into the second trigger position. The engaging surface 56 interferes with the movement of the connecting portion 62 when the lock mechanism 34 is in the engaged position. In the disengaged position, the lock mechanism 34 is configured to permit the trigger mechanism 30 to move from the first trigger position to the second trigger position. In the disengaged position, the engaging surface 56 of the lock mechanism 34 is rotated out of the path of the connecting portion 62 of the trigger mechanism 30. This permits the trigger mechanism 30 to move to the second trigger position without the engaging surface 56 of the lock mechanism 34 interfering with the movement of the connecting portion 62 of the trigger mechanism 30.

In alternative embodiments, the pump mechanism 28 is not oriented vertically when the bottle closure is in an upright position. For example, and without limitation, the pump mechanism 28, including one or more of plunger 70 and cylinder 68, may be oriented in a generally horizontal direction when the bottle closure 22 is in an upright position. The plunger 70 reciprocates horizontally when actuated by the trigger mechanism 30. Alternatively, the pump mechanism 28, including one or more of plunger 70 and cylinder 68, may be oriented at an angle between horizontal and vertical when the bottle closure 22 is in an upright position. For example, and without limitation, the pump mechanism may be oriented from vertical at an angle of 30 degrees, 45 degrees, 60 degrees, or the like.

Figure 6:
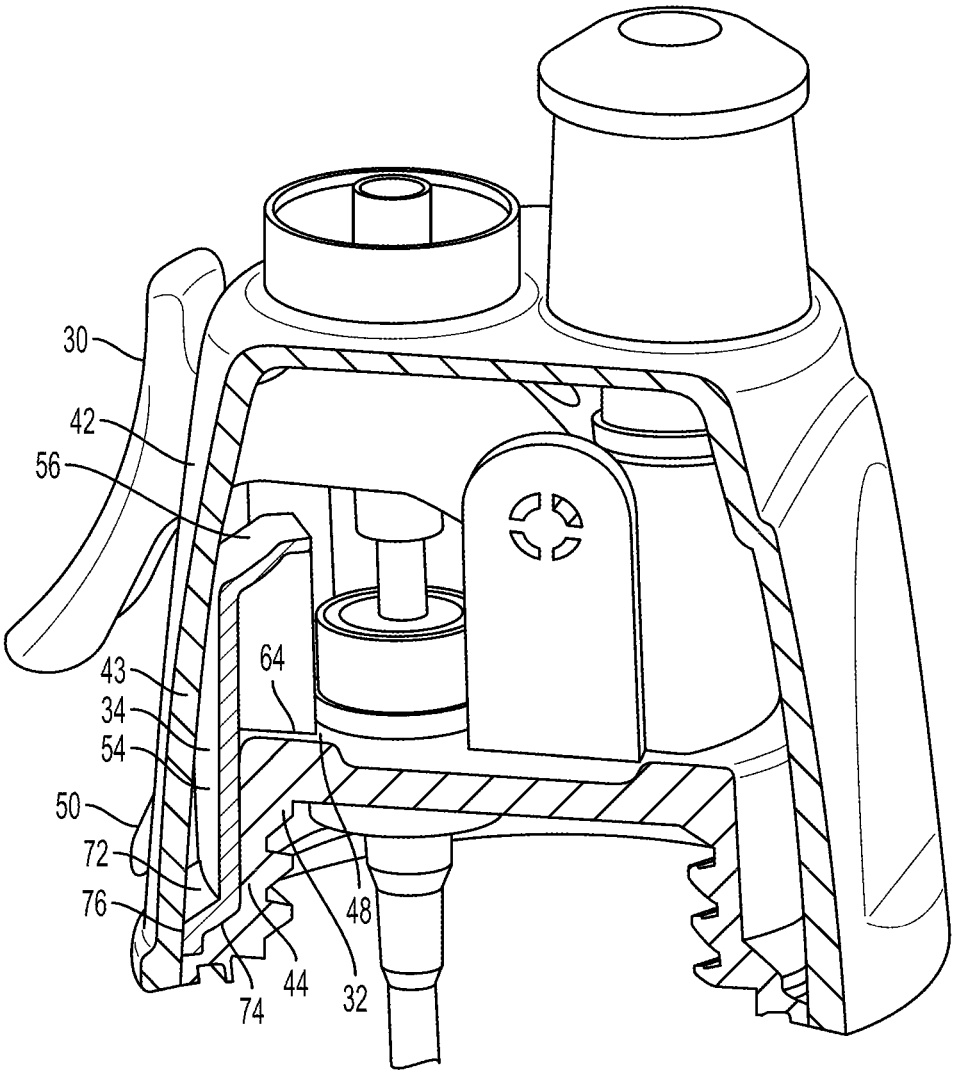
FIG. 6 is a perspective cross-sectional view of the bottle closure shown in FIG. 1.

Referring now to FIG. 6, the lock mechanism 34, the body 32, and the cover 43 of the bottle closure 22 are shown in cross section to further illustrate the relationship between the lock mechanism 34, the body 32, and the cover 43 as previously described with reference to FIGS. 2 and 3. The vertical portion 54 of the lock mechanism 34 including the flange 72 at the end opposite the engaging surface 56 are supported and engaged with an outer surface 74 of the body 32. The flange 72 is further engaged by an inner surface 76 of the cover 43. The outer surface 74 of the body 32 and the inner surface 76 of the cover 43 cooperate with the vertical portion 54 and the flange 72 of the lock mechanism 34 to limit the radial movement of the lock mechanism 34. The base portion 64 of the lock mechanism 34 and the top portion 48 of the body 32 cooperate to limit the movement of the lock mechanism in a first axial direction. The engaging surface 56 and the cover 43 cooperate to limit the movement of the lock mechanism 34 in a second axial direction.

Figure 7:
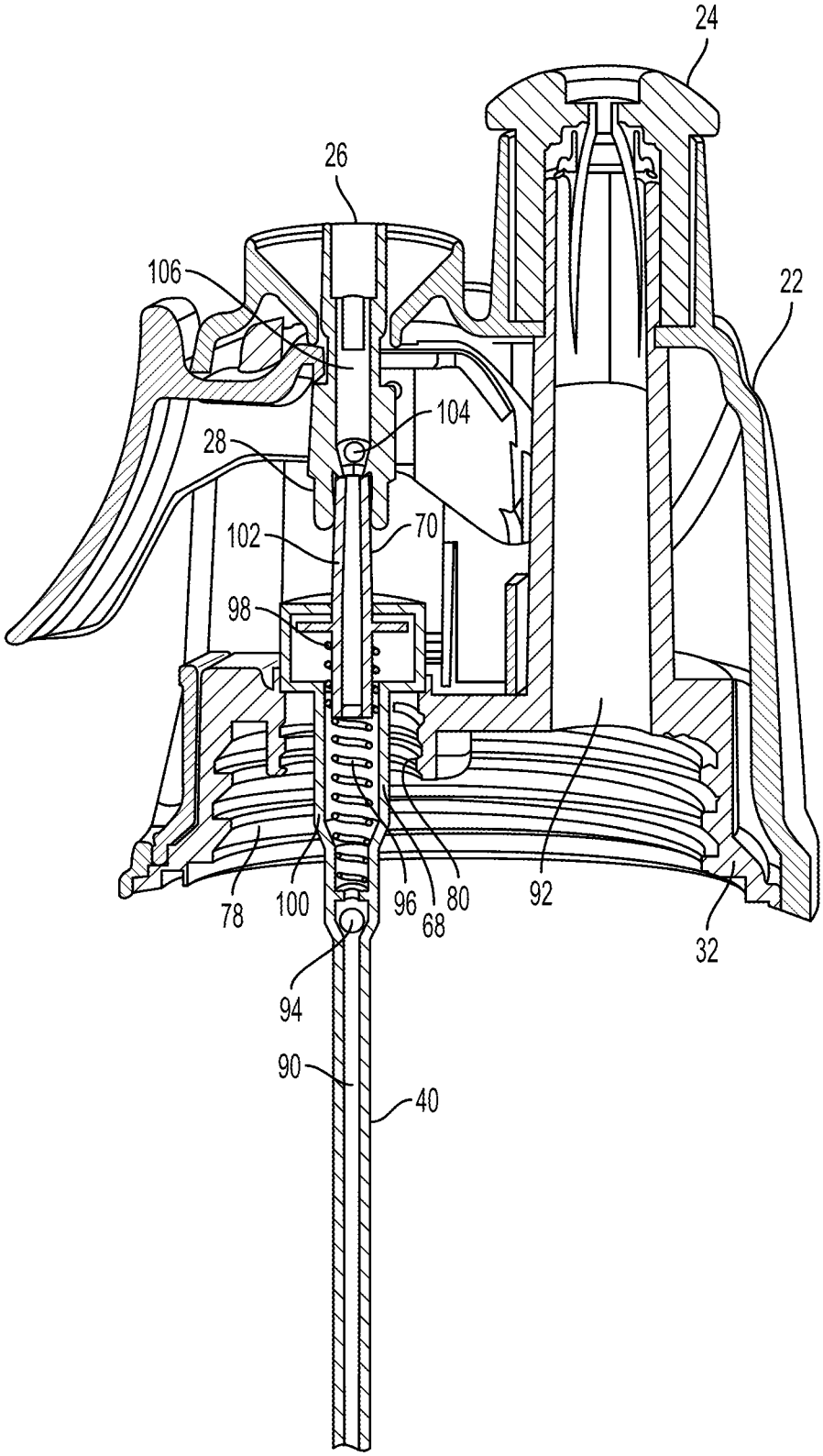
FIG. 7 is a further perspective cross-sectional view of the bottle closure shown in FIG. 1.
Figure 8:
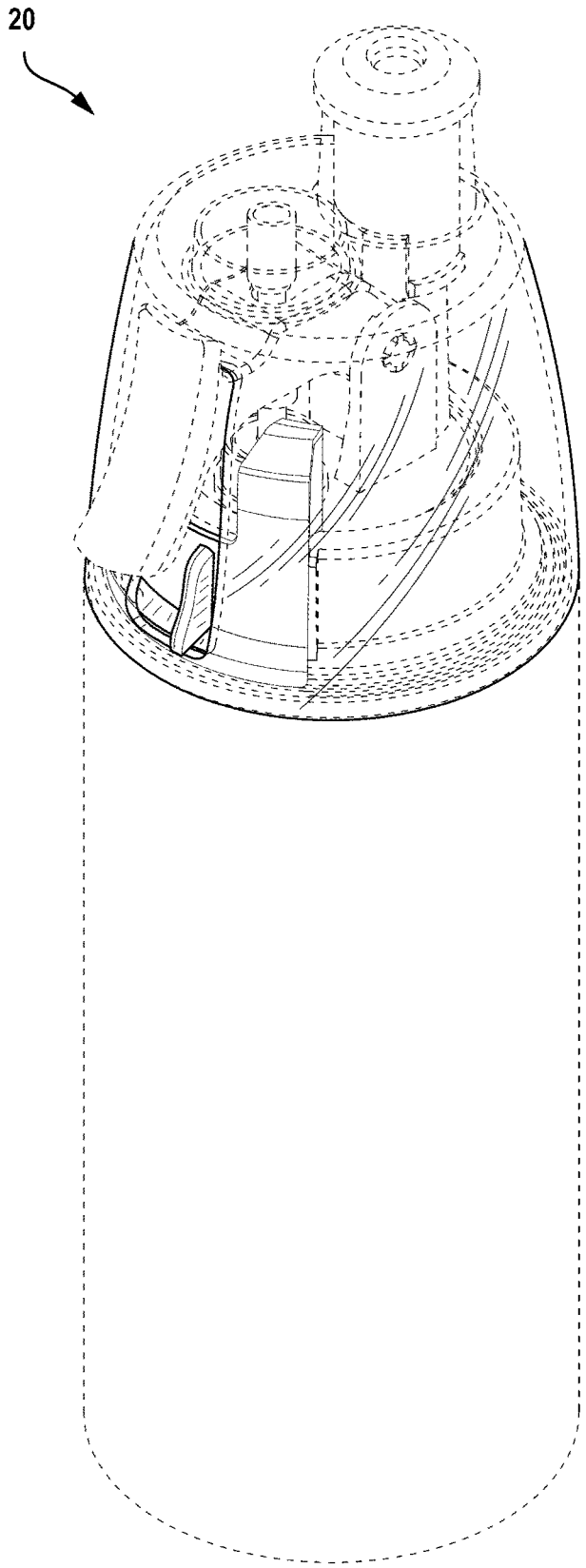
FIGS. 8-15 show additional views of the container.
Figure 9:
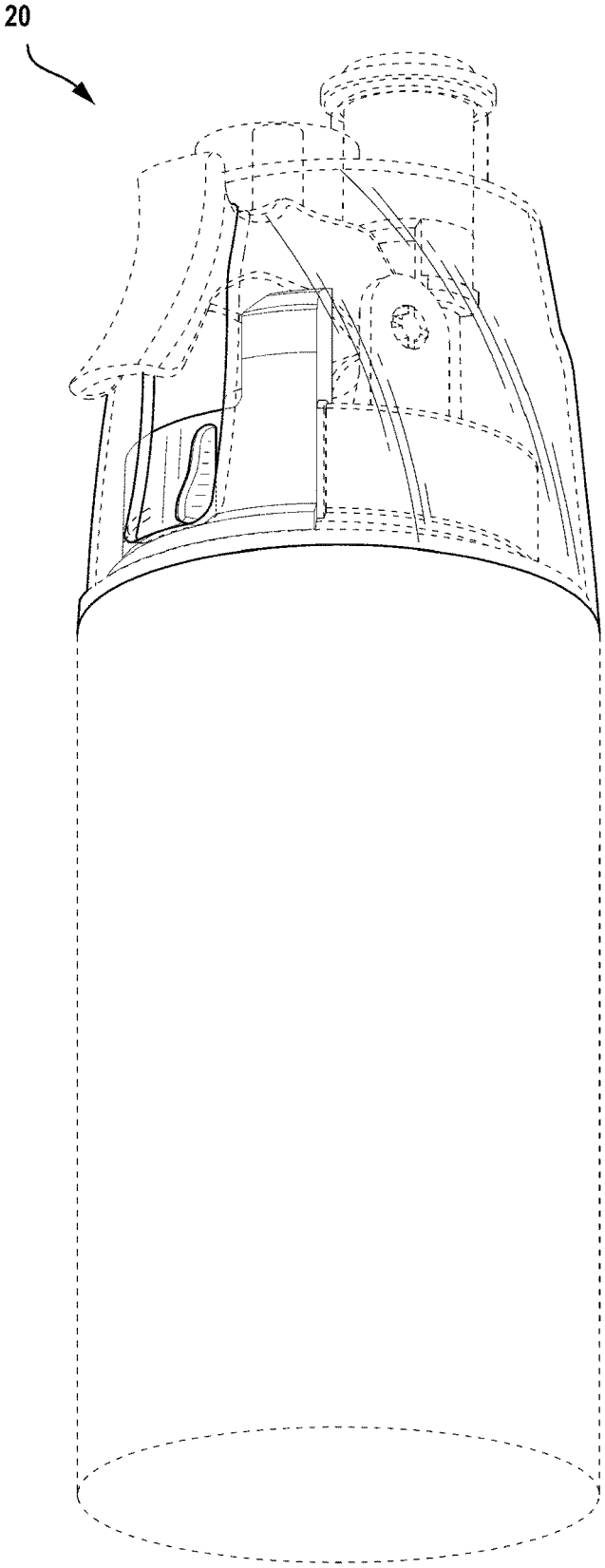
Figure 10:
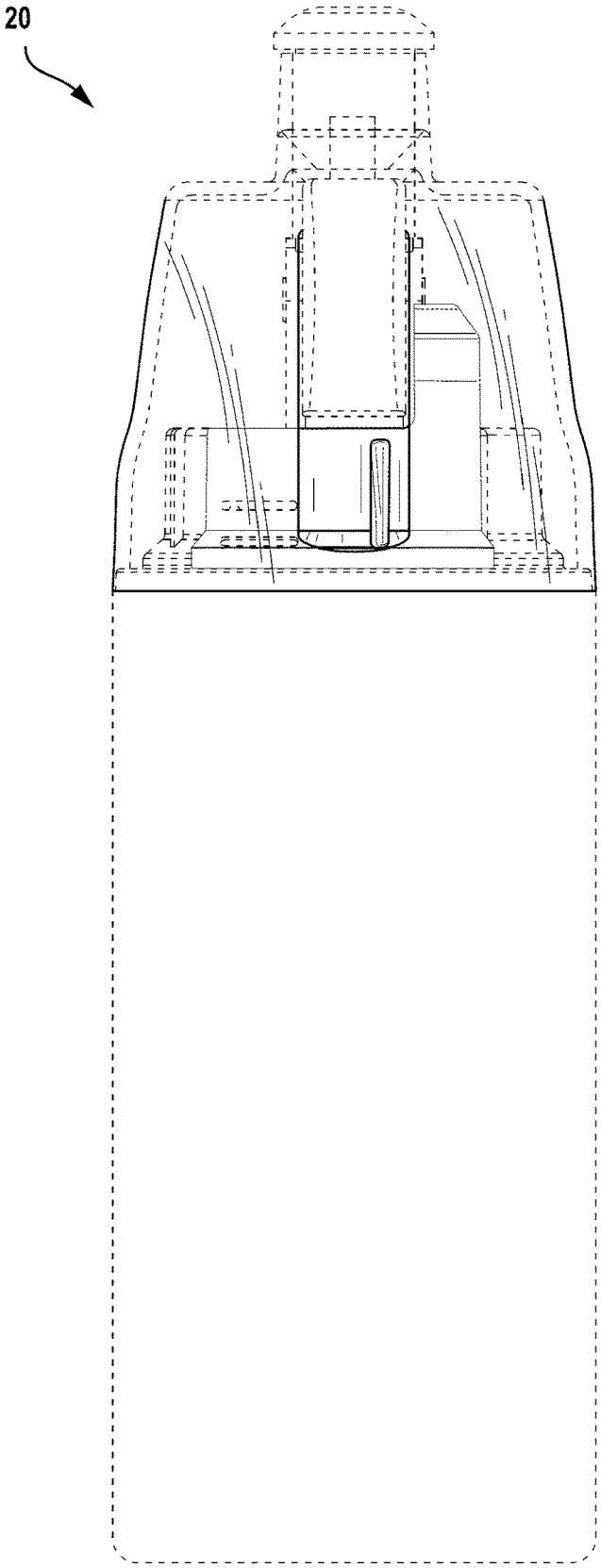
Figure 11:
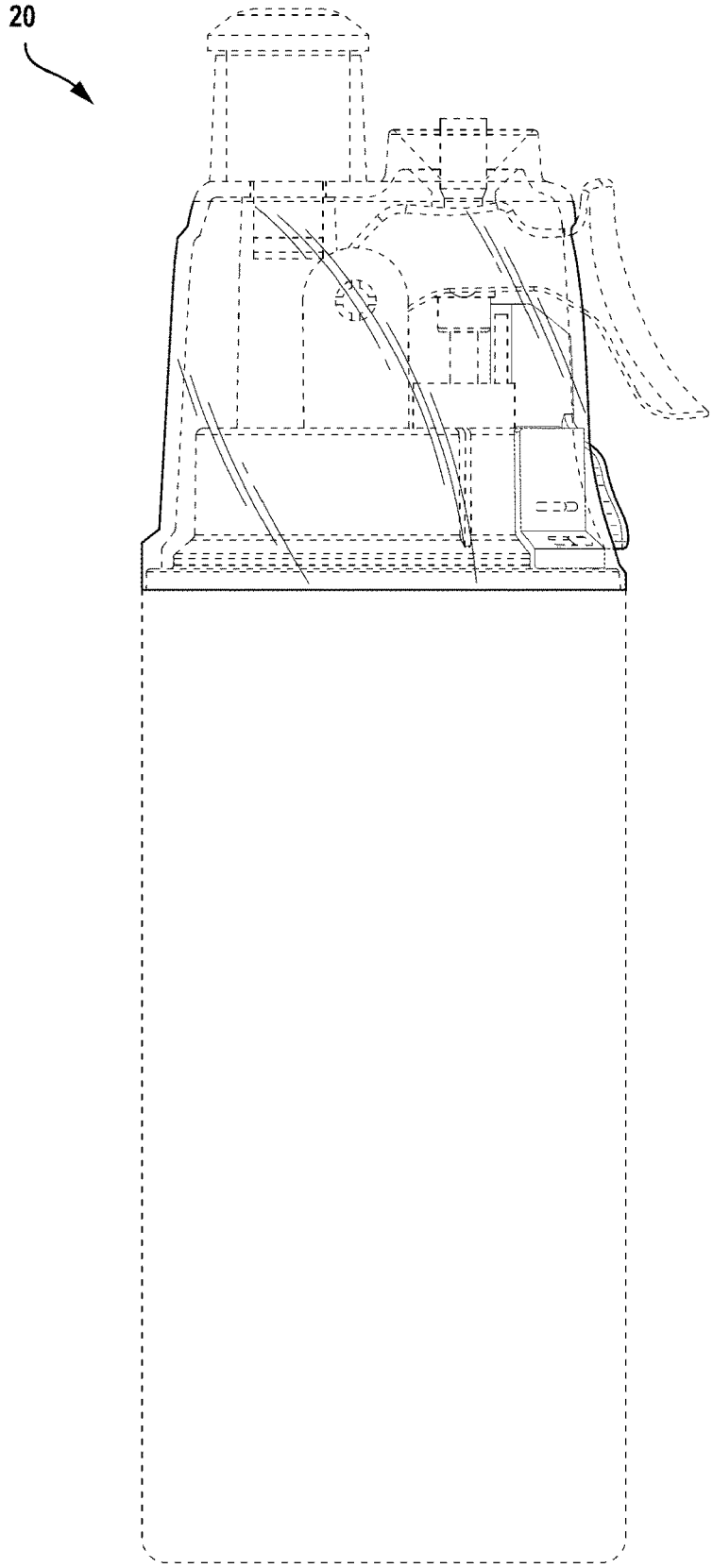
Figure 12:
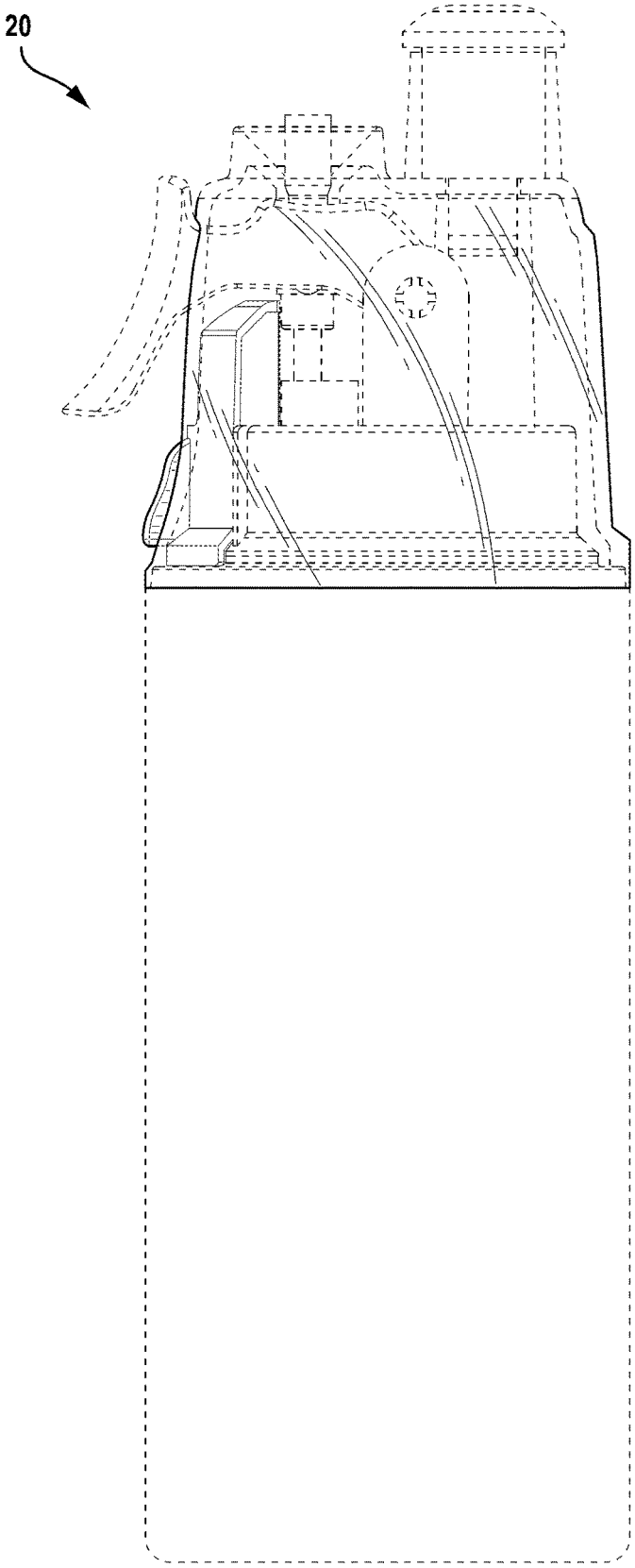
Figure 13:
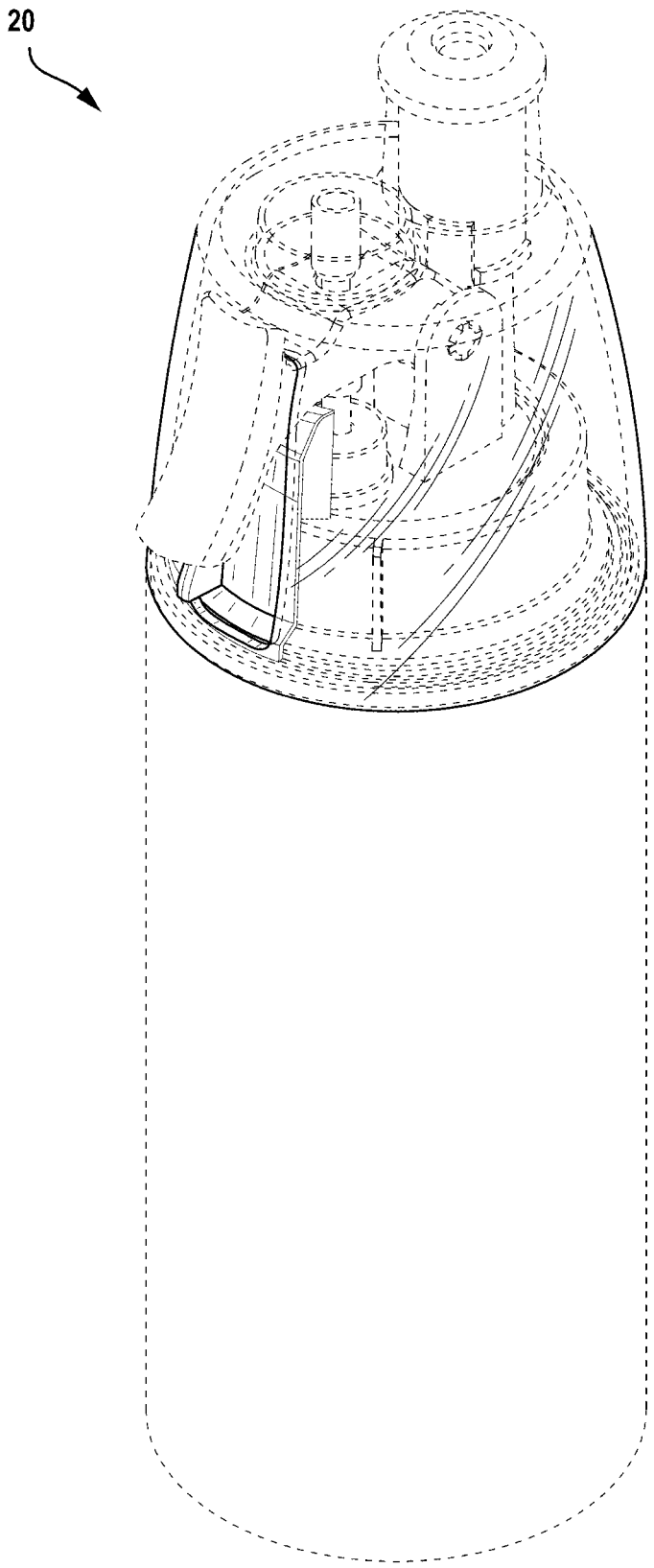
Figure 14:
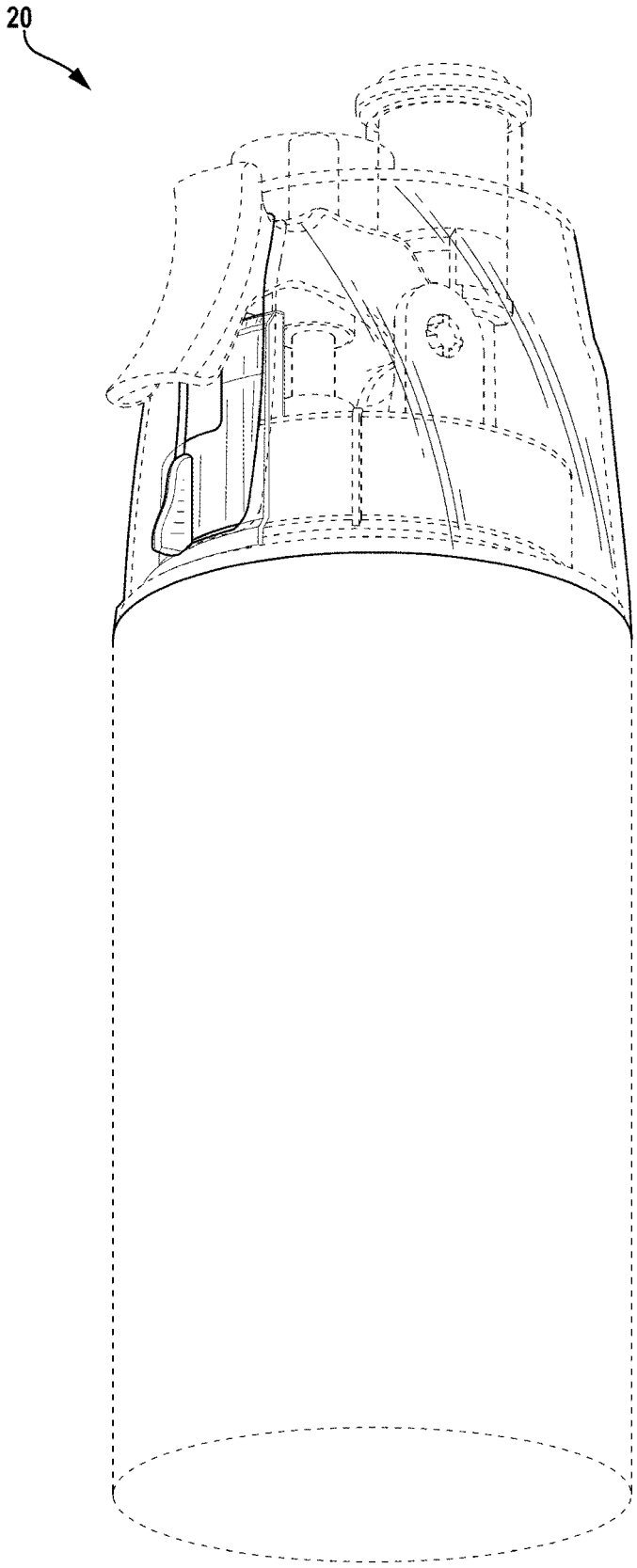
Figure 15:
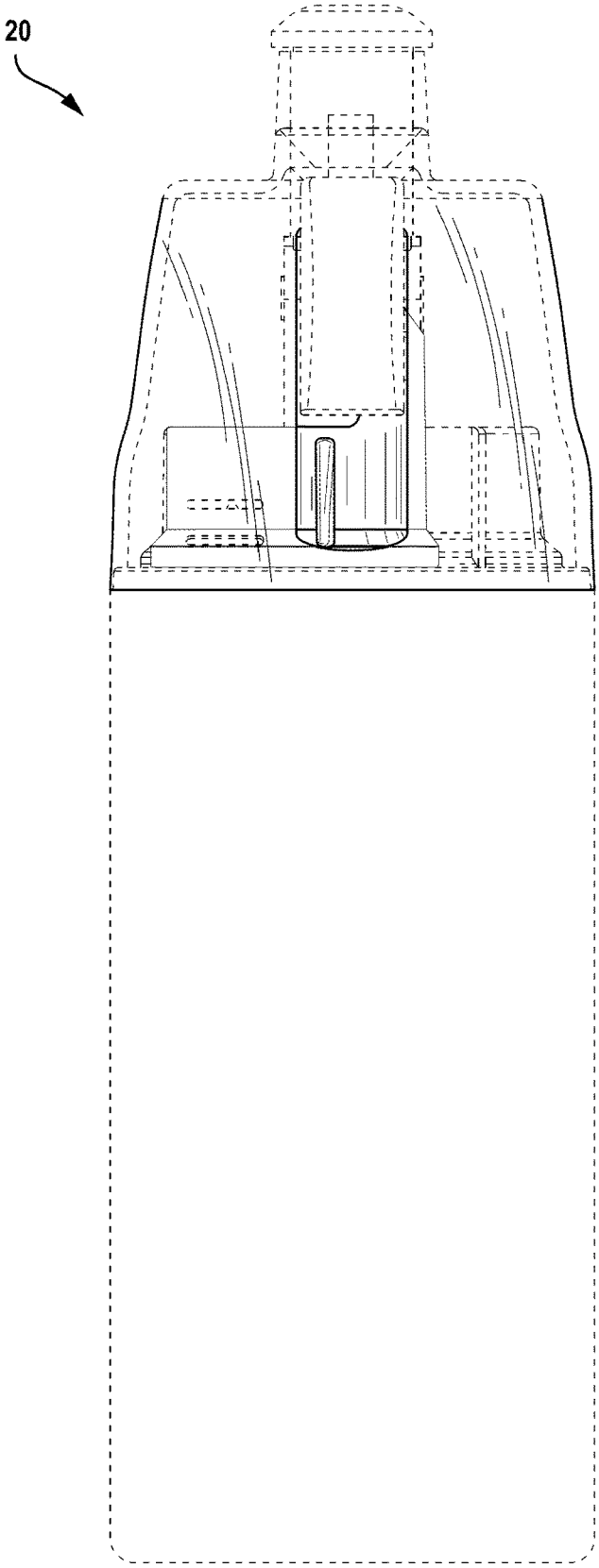

Referring now to FIG. 7, the body 32 of the bottle closure 22 includes a plurality of threads 78 adapted and configured to be engageable with a corresponding set of threads formed by the bottle finish of the bottle 36. The body 32 further includes a second plurality of threads 80 adapted and configured to be engageable with a corresponding set of threads formed by the bottle finish of the secondary bottle 38. The second plurality of threads 80 are arranged about the dip tube 40 such that the dip tube 40 is contained in the secondary bottle 38 when the secondary bottle 38 is coupled to the bottle closure 22 using the second plurality of threads 80.

The pump mechanism 28 is supported by the body 32 of the bottle closure 22. The pump mechanism 28 is coupled to dip tube 40 which partially defines a first intake liquid flow path 90. The first intake liquid flow path 90 supplies liquid to the pump mechanism 28 for discharge through nozzle 26. A second intake liquid flow path 92 is defined by the body 32 and supplies liquid for discharge through the drink spout 24.

The pump mechanism 28 includes a variable volume fluid receiving cavity 96 defined by one or more of the cylinder 68 and the plunger 70. The plunger 70 is reciprocally moveable within the fluid receiving cavity 96 between a first plunger position in which the fluid receiving cavity 96 has a first volume and a second plunger position in which the fluid receiving cavity 96 has a second volume smaller than the first volume. The plunger 70 is configured to change the volume of the fluid receiving cavity 96 as the pump mechanism 28 moves between the first plunger position and the second plunger position. A spring 98 is positioned with the pump mechanism 28 to return the plunger 70 to the first plunger position. The pump mechanism 28 includes a first check valve 94 in the first intake liquid flow path 90. The first check valve 94 is configured for permitting fluid flow to the fluid receiving cavity 96 from the first intake liquid flow path 90 and for checking fluid flow from the pump mechanism 28 to the first intake liquid flow path 90. The pump mechanism 28 further includes a second check valve 104 in a first discharge liquid flow path 106. The second check valve 104 is configured for permitting fluid flow from the fluid receiving cavity 96 to the first discharge liquid flow path 106 and for checking fluid flow from the first discharge liquid flow path 106 to the fluid receiving cavity 96. The first discharge liquid flow path 106 terminates at the first discharge aperture formed by the nozzle 26. A second discharge aperture formed by the drink spout 24 is separated from the first discharge aperture. The second discharge aperture is in fluid communication with the second intake liquid flow path 92 and forms a second discharge flow path through which liquid may be extracted. In various alternative embodiments, pump mechanism 28 has alternative configurations and constructions.

As used herein, the term "reciprocally" refers to motion that is repetitive, back and forth motion including linear motion and/or back and forth repetitive motion along an arc.

In view of the foregoing, it should be appreciated that the embodiments disclosed herein have several advantages. As show in FIG. 8-15, the bottle closure may be transparent to provide interest to the user, and/or the nozzle and the drink spout may have any shape and may be arranged on the bottle closure top surface as desired. Also, as shown in FIGS. 8-15, the container may be any shape.

As various modifications could be made in the constructions and methods herein described and illustrated without departing from the scope of the disclosure, it is intended that all matter contained in the foregoing description or shown in the accompanying drawings shall be interpreted as illustrative rather than limiting. Thus, the breadth and scope of the present disclosure should not be limited by any of the above-described exemplary embodiments, but should be defined only in accordance with the following claims appended hereto and their equivalents.

It should also be understood that when introducing elements in the claims or in the above description of exemplary embodiments of the disclosure, the terms "comprising," "including," and "having" are intended to be open-ended and mean that there may be additional elements other than the listed elements. Additionally, the term "portion" should be construed as meaning some or all of the item or element that it qualifies.

What is claimed is:

1. A bottle closure for releasable attachment to a bottle and for providing hydration to a user, the bottle closure comprising:

a drink spout adapted and configured to be in fluid communication with the bottle to enable the user to extract a liquid;

a pump mechanism adapted and configured to be in fluid communication with the bottle to enable the liquid to be pumped and discharged through a nozzle;

a trigger mechanism operatively connected to the pump mechanism and moveable between a first trigger position and a second trigger position, the trigger mechanism adapted and configured to move the pump mechanism to pump the liquid as the trigger mechanism is moved between the first trigger position and the second trigger position; and a lock mechanism having a radially extending engagement surface, the lock mechanism radially extending engagement surface being rotatable about an center axis of the bottle closure between an engaged position and a disengaged position, wherein when the lock mechanism is in the engaged position, the lock mechanism radially extending engagement surface engages the trigger mechanism to prevent the trigger mechanism from moving in an axial direction relative to the bottle closure between the first trigger position and the second trigger position, and to prevent the trigger mechanism from moving the pump mechanism and pumping of the liquid, wherein when the lock mechanism is in the disengaged position, the lock mechanism radially extending engagement surface is circumferentially spaced from the trigger mechanism to permit the trigger mechanism to move axially relative to the bottle closure between the first trigger position and the second trigger position, and to permit the trigger mechanism to move the pump mechanism and pump of the liquid;

wherein the lock mechanism is positioned at least in part between a cover of the bottle closure and a body of the bottle closure, the cover of the bottle closure extends at least in part around the body, the pump mechanism, and the lock mechanism; and wherein the cover comprises a window, a portion of the trigger mechanism extends through the window in the cover of the bottle closure, and a portion of the lock mechanism extends through the window and is adapted and configured to allow a user to rotate the lock mechanism between the engaged position and the disengaged position.

2. A bottle closure in accordance with claim 1 wherein, the trigger mechanism has a trigger portion, connecting portion, and pivot portion, the pivot portion is pivotally coupled to a body of the bottle closure, the connecting portion is adapted and configured to impart a generally vertical force to the pump mechanism when the bottle closure is in an upright position and the trigger portion is actuated and the connecting portion pivots about the body of the closure, the lock mechanism radially extending engagement surface is engageable with the connecting portion of the trigger mechanism when the lock mechanism is in the engaged position, the lock mechanism radially extending engagement surface is spaced from the connecting portion of the trigger mechanism when the lock mechanism is in the disengaged position.

3. A bottle closure in accordance with claim 2 wherein the connecting portion of the trigger mechanism extends from the body of the bottle closure in a direction substantially perpendicular to the pump mechanism when the trigger mechanism is in the first trigger position.

4. A bottle closure in accordance with claim 1, wherein the body of the bottle closure includes a stop extending radially from the body of the bottle closure, the stop is adapted and configured to be engageable with the lock mechanism to limit rotation of the lock mechanism to between the engaged position and the disengaged position.

5. A bottle closure for releasable attachment to a bottle and for providing hydration to a user, the bottle closure comprising:

a first discharge aperture for dispensing a liquid;

a body;

a pump mechanism supported by the body comprising a variable volume fluid receiving cavity and a plunger reciprocally moveable within the fluid receiving cavity between a first plunger position in which the fluid receiving cavity has a first volume and a second plunger position in which the fluid receiving cavity has a second volume smaller than the first volume, the plunger configured to change the volume of the fluid receiving cavity as the pump mechanism moves between the first plunger position and the second plunger position, the pump mechanism including a first check valve in a first intake liquid flow path configured for permitting fluid flow to the fluid receiving cavity from the first intake liquid flow path and for checking fluid flow from the pump mechanism to the first intake liquid flow path, the pump mechanism including a second check valve in a first discharge liquid flow path configured for permitting fluid flow from the fluid receiving cavity to the first discharge liquid flow path and for checking fluid flow from the first discharge liquid flow path to the fluid receiving cavity, the first discharge liquid flow path terminating at the first discharge aperture;

a trigger operatively connected to the plunger and reciprocally moveable relative to the body between a first trigger position and a second trigger position to move the plunger between the first and second plunger position, the plunger and trigger being configured such that the plunger is in the first plunger position when the trigger is in the first trigger position and the plunger is in the second plunger position when the trigger is in the second trigger position;

a lock mechanism having a radially extending engagement surface, the lock mechanism radially extending engagement surface being movable in a circumferential direction about the bottle closure between an engaged position and a disengaged position, wherein when the lock mechanism is in the engaged position, the lock mechanism radially extending engagement surface engagement surface engages the trigger to prevent the trigger from moving axially relative to the bottle closure between the first trigger position and the second trigger position, and to prevent the trigger mechanism from moving the plunger between the first and second plunger positions, wherein when the lock mechanism is in the disengaged position, the lock mechanism radially extending engagement surface engagement surface is circumferentially spaced from the trigger to permit the trigger to move axially relative to the bottle closure between the first trigger position and the second trigger position, and to permit the trigger to move the plunger between the first and second plunger positions; and a second discharge aperture separated from the first discharge aperture, the second discharge aperture in fluid communication with a second intake liquid flow path;

wherein the lock mechanism is positioned at least in part between a cover of the bottle closure and the body of the bottle closure, the cover of the bottle closure extends at least in part around the body, the pump mechanism, and the lock mechanism; and wherein the cover comprises a window, a portion of the trigger extends through the window in the cover of the bottle closure, and a portion of the lock mechanism extends through the window and is adapted and configured to allow a user to rotate the lock mechanism between the engaged position and the disengaged position.

6. A bottle closure in accordance with claim 5, wherein the trigger has a trigger portion, connecting portion, and pivot portion, the pivot portion is pivotally coupled to the body of the bottle closure, the connecting portion is adapted and configured to impart a vertical force to the pump mechanism when the trigger portion is actuated and the connecting portion pivots about the body, the lock mechanism radially extending engagement surface is engageable with the connecting portion of the trigger when the lock mechanism is in the engaged position, the lock mechanism radially extending engagement surface is spaced from the connecting portion of the trigger mechanism when the lock mechanism is in the disengaged position.

7. A bottle closure in accordance with claim 5, wherein the body of the bottle closure includes a stop extending radially from the body of the bottle closure, the stop is adapted and configured to be engageable with the lock mechanism to limit rotation of the lock mechanism to between the engaged position and the disengaged position.

8. A container for providing hydration to a user, the container comprising:

a bottle having a bottle finish; and a bottle closure adapted and configured to be releasably secured to the bottle by the bottle finish, the bottle closure comprising:

a body;

a drink spout adapted and configured to be in fluid communication with the bottle to enable a user to extract a liquid;

a pump mechanism coupled to the body and adapted and configured to be in fluid communication with the bottle and movable to enable a liquid to be pumped and discharged through a nozzle;

a trigger mechanism coupled to the body and operatively connected to the pump mechanism and moveable between a first trigger position and a second trigger position, the trigger mechanism adapted and configured to actuate the pump mechanism to pump a liquid as the trigger mechanism is moved between the first trigger position and the second trigger position; and a lock mechanism having a radially extending engagement surface, the radially extending engagement surface being rotatable about a center axis of the bottle closure between an engaged position and a disengaged position, wherein when the lock mechanism is in the engaged position, the lock mechanism radially extending engagement surface engages the trigger mechanism to prevent the trigger mechanism from moving axially relative to the bottle closure between the first trigger position and the second trigger position, and to prevent the trigger mechanism from moving the pump mechanism and pumping of the liquid, wherein when the lock mechanism is in the disengaged position, the lock mechanism radially extending engagement surface is circumferentially spaced from the trigger mechanism to permit the trigger mechanism to move axially relative to the bottle closure between the first trigger position and the second trigger position, and to permit the trigger mechanism to move the pump mechanism and pump of the liquid;

wherein the lock mechanism is positioned at least in part between a cover of the bottle closure and the body of the bottle closure, the cover of the bottle closure extends at least in part around the body, the pump mechanism, and the lock mechanism; and wherein the cover comprises a window, a portion of the trigger mechanism extends through the window in the cover of the bottle closure and a portion of the lock mechanism extends through the window and is adapted and configured to allow a user to rotate the lock mechanism between the engaged position and the disengaged position.

9. A container in accordance with claim 8, wherein the trigger mechanism has a trigger portion, connecting portion, and pivot portion, the pivot portion is pivotally coupled to the body of the bottle closure, the connecting portion is adapted and configured to impart a vertical force to the pump mechanism when the trigger portion is actuated and the connecting portion pivots about the body of the closure, the lock mechanism radially extending engagement surface is engageable with the connecting portion of the trigger mechanism when the lock mechanism is in the engaged position, the lock mechanism radially extending engagement surface is spaced from the connecting portion of the trigger mechanism when the lock mechanism is in the disengaged position.

10. A container in accordance with claim 8, wherein the body of the bottle closure includes a stop extending radially from the body of the bottle closure, the stop being adapted and configured to be engageable with the lock mechanism to limit rotation of the lock mechanism to between the engaged position and the disengaged position.

11. A container in accordance with claim 8, wherein the bottle finish comprises a first plurality of threads, and wherein the body of the bottle closure includes a second plurality of threads adapted and configured to be engageable with the first plurality of threads.

12. A container in accordance with claim 11, wherein the body of the bottle closure includes a third plurality of threads arranged about a dip tube in fluid communication with the pump mechanism, the third plurality of threads adapted and configured to be engageable with a secondary bottle positionable within the bottle.

* * * * *